United States Patent [19]

Nabulon

[11] Patent Number: 4,631,790

[45] Date of Patent: Dec. 30, 1986

[54] APPARATUS FOR TEXTURIZING OF THREADS OF ENDLESS FILAMENTS

[75] Inventor: Werner Nabulon, Rüdlingen, Switzerland

[73] Assignee: Maschinenfabrik Rieter AG, Winterthur, Switzerland

[21] Appl. No.: 736,374

[22] Filed: May 21, 1985

[30] Foreign Application Priority Data

May 30, 1984 [CH] Switzerland ..... 2656/84

[51] Int. Cl.[4] ..... D02G 1/12; D02G 1/16

[52] U.S. Cl. ..... 28/255

[58] Field of Search ..... 28/255, 256

[56] References Cited

U.S. PATENT DOCUMENTS

| | | | |
|---|---|---|---|
| 2,674,275 | 4/1954 | Blickenstorfer | 139/92 |
| 3,343,240 | 9/1967 | Parmeggiani et al. . | |
| 3,824,656 | 7/1974 | Bauch | 28/255 |
| 3,849,844 | 11/1974 | Bauch | 28/255 |
| 4,188,691 | 2/1980 | Matsumoto et al. . | |
| 4,453,298 | 6/1984 | Nabulon et al. | 28/255 |

FOREIGN PATENT DOCUMENTS

| | | | |
|---|---|---|---|
| 2545590 | 4/1977 | Fed. Rep. of Germany . | |
| 49-71242 | 7/1974 | Japan | 28/255 |

*Primary Examiner*—Robert R. Mackey

*Attorney, Agent, or Firm*—Werner W. Kleeman

[57] ABSTRACT

An apparatus for texturizing threads of endless filaments comprising a thread infeed portion, a treatment portion and a texturizing portion. The texturizing portion is provided with lamellae forming a so-called slotted nozzle. The lamellae are arranged in a substantially star-shaped or spoke-like configuration. According to the invention, these lamellae are rounded and polished on their inwardly directed lamellae faces or ends to provide optimum friction conditions between these lamellae faces and the thread to be texturized. The lamellae are removably insertably secured at their upper ends and also by means of extensions or projections provided at their lower ends in respective slots. This removable insertability of the lamellae affords the possibility of rapid exchange of such lamellae.

9 Claims, 9 Drawing Figures

APPARATUS FOR TEXTURIZING OF THREADS OF ENDLESS FILAMENTS

BACKGROUND OF THE INVENTION

The present invention relates to a new and improved construction of an apparatus for the texturizing of threads or the like of endless filaments by means of heated flowing media or a heated fluid medium.

Generally speaking, the texturizing apparatus of the present development for the texturizing of threads of endless filaments or the like by means of heated flowing media is of the type comprising a thread infeed portion for drawing-in the thread by suction, a treatment portion following the thread infeed portion and flow communicating therewith and containing a treatment chamber for heating the thread, a texturizing or stuffer portion following and adjoining the treatment portion and containing a so-called slotted nozzle in which the heated threads are packed or accumulated to form crimps in the threads. The slotted nozzle is provided with lamellae which produce the slots of the slotted nozzle. These lamellae have a substantially rectangular cross-section and are arranged in a substantially radiating or spoke-like array with one of their narrow sides or faces—also referred to sometimes herein as narrow ends or end faces—confronting the packed or accumulated thread.

Apparatuses of this type are known, for example, from the Swiss Pat. No. 527,931, granted Sept. 15, 1972, and basically cognate with U.S. Pat. No. 3,849,844, granted Nov. 26, 1974, in which the lamellae have a substantially rectangular cross-section and are fixedly arranged in a radiating array with a narrow face or side facing the accumulated thread.

During the use of so-called slotted nozzles for texturizing threads of endless filaments, there exists the problem that the thread loops located in the texturizing or stuffer chamber project to a greater or lesser extent into the spaces or slots between the lamellae in dependence upon the degree of plasticization of the threads, or the preceding treatment of the threads by any kind of treatment medium or dyeing agent, and also in dependence upon the friction conditions prevailing at the faces or ends of the lamellae directed towards the thread. Consequently, the friction conditions for the continued movement of the accumulated or packed thread in this texturizing or stuffer chamber vary in an indeterminate manner.

A further disadvantage of the state-of-the-art constructions resides in the fact that the friction conditions experience a continual variation or change as a result of the wear of the end faces of the lamellae. This necessitates a continuous control or checking of the textured product and, at the same time, an appropriate adaptation of the operating conditions with respect to the infeed of the treatment medium, or, respectively, a frequent replacement of the slotted nozzles.

Such frequent replacement of these slotted nozzles and such frequent checking of the produced yarn or the like constitute extremely labor intensive, and thus time-consuming and expensive operations.

SUMMARY OF THE INVENTION

Therefore, with the foregoing in mind, it is a primary object of the present invention to provide a new and improved construction of an apparatus for the texturizing of threads of endless filaments or the like which is devoid of the aforementioned drawbacks and limitations of the prior art constructions.

A further significant object of the present invention aims at providing a new and improved construction of an apparatus for the texturizing of threads of endless filaments or the like by means of a heated flowing treatment medium in which the crimp characteristics of the textured thread lie within acceptable tolerances over a fairly long period of time with substantially unaltered conditions of the infeed of the treatment medium.

Another important object of the present invention is directed toward the avoidance of frequent replacement of the slotted nozzle.

Still a further significant object of the present invention is directed to a new and improved construction of an apparatus for the texturizing of threads of endless filaments or the like by means of heated flowing media in which each lamella is structured as a substantially flat steel part which is rounded and polished at the thread-guiding end face thereof which confronts the accumulated thread or the like in the stuffer chamber.

A further important object of the present invention is directed to the provision of a new and improved construction of an apparatus for the texturizing of threads of endless filaments or the like by means of heated flowing media in which the lamellae are readily replaceably mounted in the slotted nozzles, in other words, are removably insertably mounted therein.

Yet a still further significant object of the present invention aims at providing a new and improved construction of an apparatus for the texturizing of threads of endless filaments or the like in which, due to the rounding of the lamellae end faces and the polishing of such rounded lamellae end faces, there is realized the possibility of forming these thread-guiding surfaces, defined by such rounded and polished lamellae end faces, such that the operating conditions produced by the friction between the thread and these thread-guiding surfaces experience substantially less change during wear of the rounded and polished lamellae end faces.

Now in order to implement these and still further objects of the invention, which will become more readily apparent as the description proceeds, the texturizing apparatus of the present development is manifested by the features that each lamella comprises a flat steel portion or part which is rounded and polished at its thread-guiding face or surface which confronts or traces the accumulated thread in the stuffer chamber.

According to a further aspect of the invention, the lamellae are exchangeably or replaceably mounted in the slotted nozzles, that is to say, are removably insertably mounted therein.

One of the major advantages of the present invention resides in the fact that, due to the rounding of the lamellae end faces and the polishing of such rounded lamellae end faces, there is realized the possibility of forming these thread-guiding surfaces, defined by such lamellae end faces, such that the operating conditions produced by the friction between the thread and these thread-guiding surfaces is subjected to substantially less change during wear of the rounded and polished lamellae end faces.

Due to the exchangeable mounting or attachment of the lamellae, there is realized the further advantage that the lamellae can be exchanged or replaced in a simple manner after a predetermined time interval, so that the operating conditions remain within acceptable tolerances.

DETAILED DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

Figure 1:
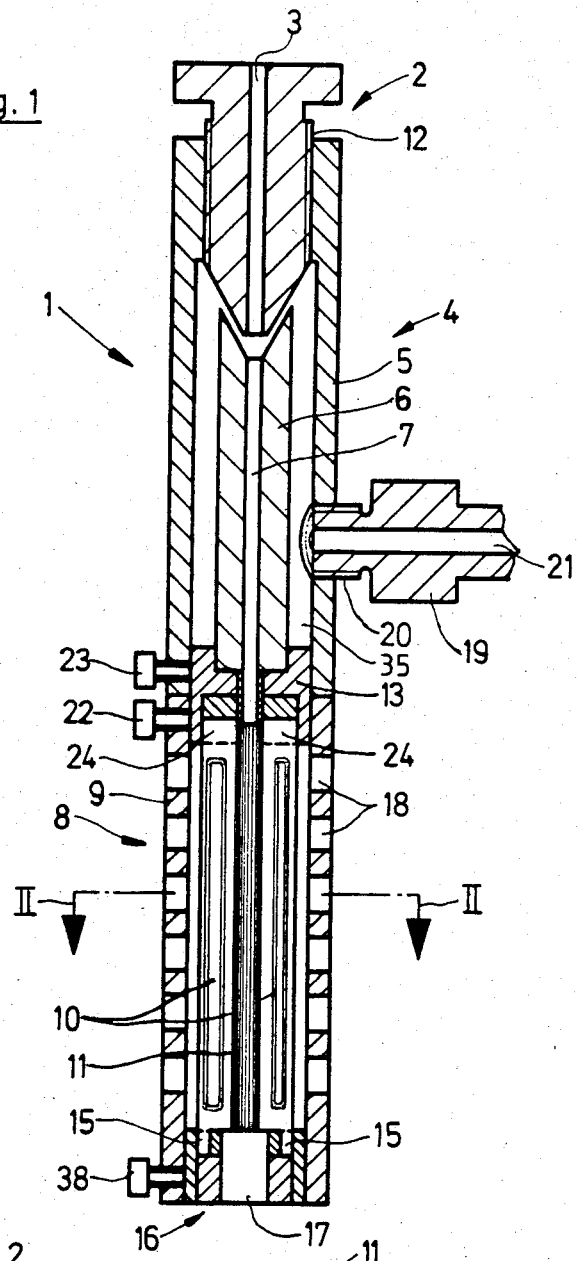
FIG. 1 illustrates an exemplary embodiment of texturizing apparatus constructed according to the present invention, illustrated part schematically in longitudinal section taken substantially along section lines I—I of FIG. 2.
Figure 5:
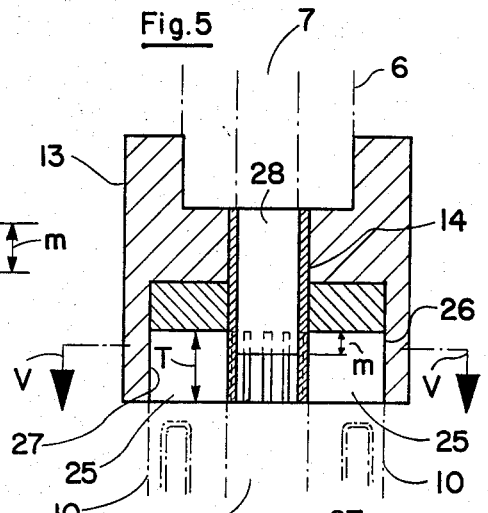
Figure 6:
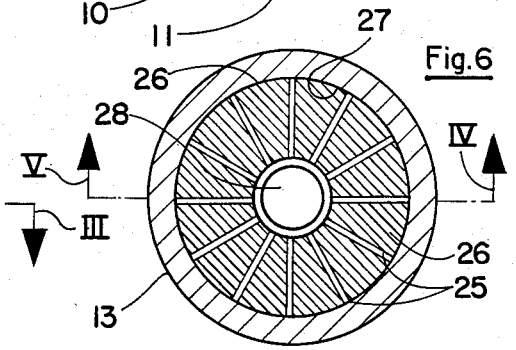
Figure 7:
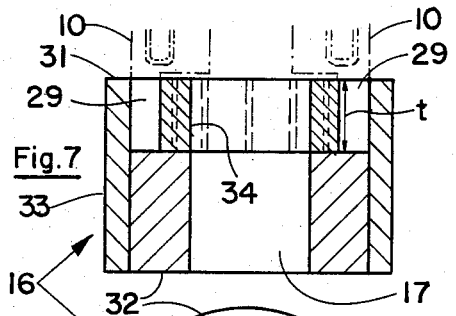
Figure 4:
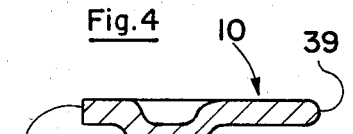
FIG. 4 illustrates a cross-section of the texturizing apparatus illustrated in FIG. 3, taken substantially along the section lines III—III thereof.
Figure 4A:
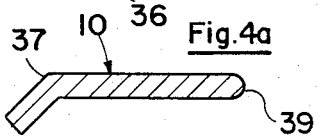
Figure 8:
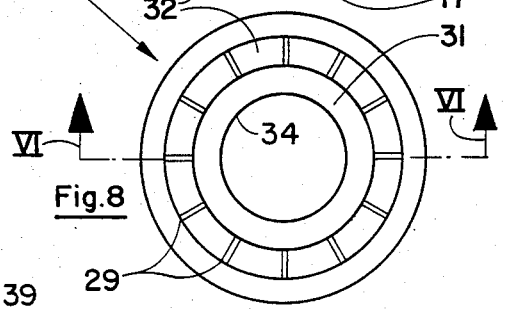

FIG. 4*a* illustrates a modified embodiment of the texturizing apparatus shown in FIG. 4 in a view similar to FIG. 4;

FIG. 5 illustrates a longitudinal section of part of the texturizing apparatus shown in FIG. 1, taken substantially along the lines IV—IV of FIG. 6 and shown on an enlarged scale;

FIG. 6 illustrates a section of the texturizing apparatus shown in FIG. 5, taken substantially along the lines V—V thereof;

FIG. 7 illustrates a longitudinal section of part of the texturizing apparatus according to FIG. 1, taken substantially along the lines VI—VI of FIG. 8 and shown on an enlarged scale; and FIG. 8 illustrates a plan view of the arrangement depicted in FIG. 7.

DETAILED DESCRIPTION OF THE PREFERRED EMBODIMENTS

Describing now the drawings, it is to be understood that only enough of the construction of the apparatus for the texturizing of threads of endless filaments or the like by means of heated flowing media has been shown as is needed for those skilled in the art to readily understand the underlying principles and concepts of the present development, while simplifying the showing thereof. Turning attention now specifically to FIG. 1 of the drawings, the exemplary embodiment of texturizing apparatus 1 comprises a thread infeed portion or part 2 for suctionally drawing-in the thread or the like to be texturized and possessing a thread infeed passage or channel 3, a substantially arranged and therewith merging or adjoining treatment portion or part 4 provided with an outer tube 5 and an inner tube 6 located in the outer tube 5 and enclosing a treatment chamber 7.

Furthermore, the texturizing apparatus 1 comprises a texturizing portion or part 8 following and adjoining the treatment portion or part 4. This texturizing portion or part 8 has a perforated outer tube 9 and a plurality of lamellae or small plates 10 located therein which define or bound a stuffer chamber or compartment 11 in which the thread or other like filamentary material can be packed or accumulated.

The thread infeed portion or part 2 is connected to the outer tube 5 by means of any suitable screw-thread or threaded portion 12 while the outer tube 5 and the perforated outer tube 9 are centered by an inner connecting or connection element 13 and connectable together by means of screws or threaded bolts 22 and 23, respectively, or equivalent connection elements. The inner connecting element 13 also serves, on the one hand, to securely receive the inner tube 6 as shown in chain-dotted lines in FIG. 5 and, on the other hand, to releasably or removably receive the upper ends 24 of the lamellae 10 as viewed with respect to the showing of FIG. 1 (see also FIG. 3).

For this purpose, the inner connecting or connection element 13 has an annular or ring-shaped insert 26 provided with slots 25 (FIGS. 5 and 6). This annular insert 26 is securely seated in a substantially cylindrical recess 27 of the inner connecting element 13.

The slots 25 have a depth indicated by reference character T (FIG. 5) for receiving the upper ends 24 of the lamellae 10. For radial centering of these upper lamellae ends 24, there is provided a coaxial connecting tube 14. This coaxial connecting or connection tube 14 covers a length m of the slots 25 (FIGS. 3 and 5).

Figure 3:
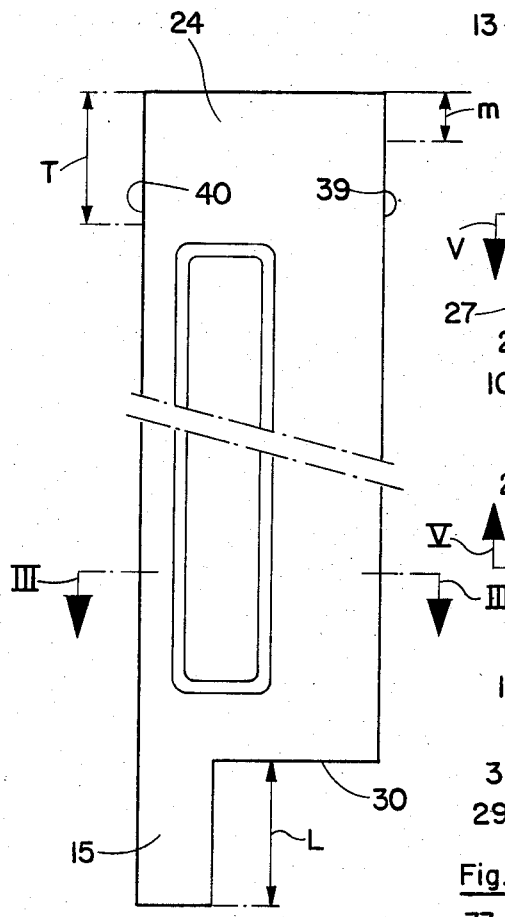
FIG. 3 illustrates a front view of a part of the texturizing apparatus according to FIG. 1 and shown on an enlarged scale.

Thus, as indicated in FIG. 3 with chain-dotted lines, the upper lamellae ends 24 are supported radially, viewed with reference to the lengthwise or longitudinal axis of the texturizing apparatus 1, at their inner rounded and polished end faces or ends 39 over the length m and at the outer lamellae end faces or ends 40 over the length T. These inner rounded and polished end faces or ends 39 of the lamellae 10, and which define thread-guiding surfaces, advantageously may possess a roughness value Ra of at least $0.2\mu$ and preferably approximately $0.4\mu$. Such inner rounded lamellae end faces or ends 39, advantageously possess a radius which substantially corresponds to one-half the thickness of the related lamella. The inner rounded and polished lamellae end faces or ends 39 also may possess a rolled curvature, sometimes referred to as a pressure formed curvature.

The tolerances on all sides are chosen such that the upper lamellae ends 24 of each of the lamellae 10 are snugly seated, that is to say, practically without any free play, in their associated slot 25.

The coaxial connecting tube 14 also has a connecting or connection bore 28 which connects or flow communicates the treatment chamber 7 with the stuffer or texturizing chamber 11.

The lower end of each of the lamellae 10, formed as an extension or projection 15 as shown in FIG. 3, is also firmly or snugly seated in related slots 29 of an exit or outlet portion or part 16 (FIGS. 7 and 8). The length L of each such extension or projection 15 is somewhat longer than the depth t of the related slot 29, so that an end surface 30 (FIGS. 3 and 7) of each such lamella 10 does not engage or contact the inner end face or surface 31 of the exit portion or part 16.

Figure 2:
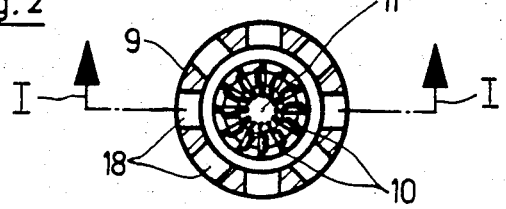
FIG. 2 illustrates a cross-section of the texturizing apparatus depicted in FIG. 1, taken substantially along the section lines II—II of FIG. 1 and illustrated part schematically.

A lamella 10 is removably inserted into each lamellae-receiving slot 25 and 29, respectively, so that the array of the thus removably mounted lamellae 10 are arranged star-fashion or in a radiating or spoke-like configuration as illustrated in FIG. 2, to thereby form the intermediate spaces or slots of the thus constructed slotted nozzle.

For formation of the lamellae-receiving slots 29, the exit portion or part 16 comprises a ring member or body 32 provided with these radially extending slots 29, a sleeve 33 encircling this ring member or body 32 and an inner ring or ring member 34.

Additionally, the exit portion or part 16 is provided with an exit bore or opening 17 through which the textured or texturized thread (not illustrated) and a portion of the treatment medium leave the texturizing apparatus 1.

The other portion of the treatment medium which escapes between the lamellae 10, i.e. between the slots or intermediate spaces formed between each two neighboring lamellae, leaves through the exit bores or openings 18 of the perforated outer tube 9.

A connection means or connection element 19 secured in the outer tube 5 by means of a suitable screw-thread or threaded connection 20 serves for the supply of the treatment medium into the treatment chamber 7 of the texturizing apparatus 1.

In particular, the treatment medium is supplied via a feed passage or channel 21 provided in the connection means 19 into a substantially ring-shaped chamber 35 located between the outer tube 5 and the inner tube 6. From this ring-shaped chamber 35, the treatment medium passes into the treatment chamber 7.

In order to improve their bending strength, each of the lamellae or small plates 10 are provided with a bead or rib 36. Instead of using such reinforcing or strengthening beads or ribs 36, any other means or expedients could be provided for the same purpose, such as a bend 37 as illustrated in FIG. 4*a*. The type and arrangement of the lamellae-receiving slots must be correspondingly adapted.

The length of the reinforcing or strengthening bead or rib 36 substantially corresponds to the distance between the upper lamella end 24 and the extension or projection 15 of the related lamella 10 i.e. extends substantially over the entire length of the related lamella 10.

A screw or threaded bolt 38 or equivalent structure set or screwed into the perforated outer tube 9 serves to positionally secure the exit portion or part 16.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. An apparatus for the texturizing of threads of endless filaments or the like by means of heated flowing media, comprising:

a thread infeed portion of suctionally drawing-in a thread;

a treatment portion following and adjoining said thread infeed portion;

said treatment portion being provided with a treatment chamber for heating the drawn-in thread;

a texturizing portion following and adjoining said treatment portion;

said texturizing portion comprising a slotted nozzle in which the heated thread is accumulated to form crimps in the thread;

said slotted nozzle being provided with lamellae producing slots of said slotted nozzle;

said lamellae having narrow faces, with one narrow face of each lamella confronting the accumulated thread and defining a thread-guiding face;

each of said lamellae having a substantially rectangular cross-section and being arranged in a radiating array;

each of said lamellae comprising a substantially flat steel portion which is rounded and possesses a rolled curvature and which is polished to a roughness value of at least 0.2 micrometer at said thread-guiding face thereof defined by said narrow face which confronts the accumulated thread; and said rounded and polished thread-guiding face of each of said lamellae mitigating against wear thereof which would result in uncontrolled varying friction and texturizing conditions.

2. The apparatus as defined in claim 1, wherein:

said rounded and polished face of each said lamella has a radius which substantially corresponds to one-half the thickness of the lamella.

3. The apparatus as defined in claim 1, wherein:

each of said lamellae is provided in the region of a narrow face thereof facing away from the thread with a longitudinally directed reinforcement for increasing the bending strength of each said lamellae.

4. The apparatus as defined in claim 3, wherein:

said reinforcement comprises a bead extending over substantially the whole length of the lamella.

5. The apparatus as defined in claim 1, wherein:

said rounded and polished thread-guiding face has a roughness value of approximately 0.4$\mu$.

6. The apparatus as defined in claim 1, further including:

means for exchangeably securing said lamellae in said slotted nozzle.

7. The apparatus as defined in claim 6, wherein:

said exchangeably securing means comprises an upper support and a lower support which, for the insertion of the lamellae, are provided with slots arranged in a substantially radiating array.

8. The apparatus as defined in claim 7, further including:

a perforated outer tube receiving said upper and lower supports and for retaining together said upper and lower supports and the lamellae inserted therein.

9. An apparatus for the texturizing of threads of endless filaments or the like by means of heated flowing media, comprising:

a thread infeed portion for suctionally drawing-in a thread;

a treatment portion following and adjoining said thread infeed portion;

said treatment portion being provided with a treatment chamber for heating the drawn-in thread;

a texturizing portion following and adjoining said treatment portion;

said texturizing portion comprising a slotted nozzle in which the heated thread is accumulated to form crimps in the thread;

said slotted nozzle being provided with lamellae producing slots of said slotted nozzle;

said lamellae having narrow faces, with one narrow face of each lamella confronting the accumulated thread and defining a thread-guiding face;

each of said lamellae having a substantially rectangular cross-section and being arranged in a radiating array;

each of said lamellae being structured as a substantially flat plate-like element which is rounded and possesses a rolled curvature and which is polished to a roughness of at least 0.2 micrometer at said thread-guiding face thereof defined by said narrow face which confronts the accumulated thread; and said rounded and polished thread-guiding face of each of said lamellae mitigating against wear thereof which would result in uncontrolled varying friction and texturizing conditions.

* * * * *